US005772125A

United States Patent [19]

Ehinger et al.

[11] Patent Number: 5,772,125

[45] Date of Patent: Jun. 30, 1998

[54] MACHINE FOR SPRAYING A COATING MATERIAL

[75] Inventors: Pierre Ehinger, Faverged; Djamel Merabot, Grenoble, both of France

[73] Assignee: Sames S.A., Melan, France

[21] Appl. No.: 530,206

[22] PCT Filed: Mar. 31, 1994

[86] PCT No.: PCT/FR94/00364

§ 371 Date: Sep. 28, 1995

§ 102(e) Date: Sep. 28, 1995

[87] PCT Pub. No.: WO94/22590

PCT Pub. Date: Oct. 13, 1994

[30] Foreign Application Priority Data

Apr. 1, 1993 [FR] France ..... 93 03829

[51] Int. Cl.[6] ..... B05B 5/00

[52] U.S. Cl. ..... 239/694; 239/708; 239/112; 239/750; 118/302; 118/322

[58] Field of Search ..... 239/112, 302, 239/303, 304, 305, 690, 694, 700, 701, 702, 703, 708, 750, 751, 752; 901/43; 118/302, 310, 322, 704

[56] References Cited

U.S. PATENT DOCUMENTS

| | | | |
|---|---|---|---|
| 3,301,488 | 1/1967 | Norris | 239/752 |
| 3,674,207 | 7/1972 | Carbonetti, Jr. et al. | 901/43 |
| 4,660,771 | 4/1987 | Chabert et al. | 239/752 |
| 4,721,630 | 1/1988 | Takeo et al. | 239/751 X |
| 4,785,760 | 11/1988 | Tholome | 118/323 |
| 4,872,417 | 10/1989 | Kuwabara et al. | 239/750 |
| 4,944,459 | 7/1990 | Watanabe et al. | 901/43 |
| 4,951,600 | 8/1990 | Soshi et al. | 901/43 |
| 5,029,755 | 7/1991 | Schmidt et al. | 901/43 |
| 5,085,374 | 2/1992 | Okuda et al. | 239/751 |
| 5,100,057 | 3/1992 | Wacker et al. | 239/223 |
| 5,127,363 | 7/1992 | Nakamura et al. | 901/43 |
| 5,336,321 | 8/1994 | Sugata et al. | 901/43 |
| 5,346,140 | 9/1994 | Campbell | 239/752 |

FOREIGN PATENT DOCUMENTS

| | | |
|---|---|---|
| 0 178 746 | 5/1985 | European Pat. Off. . |
| 2 679 795 | 7/1991 | France . |
| 4141262 | 5/1992 | Japan . |
| 2 166 982 | 10/1985 | United Kingdom . |

*Primary Examiner*—Andres Kashnikow
*Assistant Examiner*—Lisa Ann Douglas
*Attorney, Agent, or Firm*—Pillsbury Madison & Sutro

[57] ABSTRACT

A machine with an on-board supply tank for spraying a coating material. In one embodiment, the spraying machine includes a carriage (3) supporting an arm (4) with an end-mounted holder containing a tank (6) for supplying a spray nozzle (8). The arm further includes a coating material changing assembly (9) which is translatably movable towards the holder (5) to effect mutual engagement between quick connection units (12, 13) during cleaning/filling of the tank (6). The machine is useful for forming coatings consisting of an electrically conductive material.

27 Claims, 4 Drawing Sheets

MACHINE FOR SPRAYING A COATING MATERIAL

BACKGROUND OF THE INVENTION

The invention concerns a machine for spraying a coating material electrostatically onto objects such as automotive vehicle bodies.

On a production line, the bodies are displaced by a conveyor and the installation for spraying the coating material comprises in general several machines called "lateral machines" intended to coat the sides of the bodies and a machine called a "roof machine" comprising a horizontal beam perpendicular to the path of travel of the bodies and intended to coat the horizontal surfaces such as the hood, the roof and the trunk lid of the bodies. Each lateral machine carries an automatic sprayer of the pneumatic or rotary type and the roof machine carries in general three sprayers of the same type.

The complexity of operating these machines resides principally in the feeding of a coating material to the sprayers while they are susceptible to large amplitude movements. Long tubing must be provided.

In the patent FR 2 609 252, the Applicant proposed a machine for spraying a coating material constituted by a multiaxis robot carrying a supply tank and an associated sprayer. During the spraying phases, the supply tank is uniquely in communication with the associated sprayer. When it is necessary to clean and fill the supply tank, the multiaxis robot approaches a stationary installation situated in the booth and connects the reservoir to appropriate fluid circulation circuits, with the aid of rapid connection means.

This installation has advantages but it is not always possible to utilize multiaxis robots, i.e. an elaborate and costly system in comparison with the "lateral machines" and "roof machines" most often utilized. In addition, the time available for carrying out the cleaning and filling operations is very short, less than 10 seconds on an automotive vehicle production line. Consequently, the time allowed for the robot to reach the cleaning-filling station is lost for other operations. The invention aims at resolving these problems.

BRIEF SUMMARY OF THE INVENTION

It concerns a machine for spraying a coating material, of the type supporting at least one sprayer and an on-board supply tank in proximity to said sprayer, characterized that it also supports a coating material changing assembly on board a mobile subassembly of said machine also supporting said sprayer and said supply tank.

What is meant by "coating material changing assembly" is a unit known per se which permits cleaning and filling the on-board supply tank with a predetermined color. This unit thus comprises gates connected to supply tubes for the coating material, to a solvent supply tube and to an air supply tube.

This construction thus permits retention of the advantages of the system described in the patent FR 2 609 252, while limiting the dead time since it is no longer necessary to displace, over a certain distance, the supply tank toward the coating material changing assembly. This latter is supported by the machine in proximity to the supply tank, whether it acts as a "lateral machine", a "roof machine" or even a multiaxis robot. The quantities of coating material engaged downstream of the coating material changing assembly are optimized. In effect, at each filling operation, the supply tank receives only the quantity necessary for coating an object and the volume of lost coating material at each change of color is thus minimized.

According to a variation of the invention, the coating product changing assembly is movable between a position where it is connected to the supply tank and a position where it is isolated. This configuration is particularly adequate in the case of the use of conductive coating materials such as water soluble paints. In effect, with such paints, if one wishes to spray electrostatically, it is imperative to isolate the sprayer placed at a high voltage from the coating product feeding circuits at ground potential. The connection between the supply tank and the coating material changing assembly permits such an isolation. It is sufficient to provide a sufficient distance between the supply tank and the coating material changing assembly during the coating phases where they must be isolated from one another. This distance then permits achievement of an electrical isolation in addition to the desired fluid isolation.

According to another variation of the invention, the assembly supporting the supply tank and the sprayer is mobile. The coating material changing assembly is thus either mobile or fixed and the same electrical isolation and fluid isolation can be realized, as indicated hereabove.

BRIEF DESCRIPTION OF THE SEVERAL VIEWS OF THE DRAWING

The invention will be better understood and other advantages thereof will be brought more clearly to light from the description which will follow, of several embodiments of a coating material spraying machine according to its principle, given uniquely by example and set forth with reference to the attached drawings in which.

DETAILED DESCRIPTION OF THE INVENTION

Figure 1:
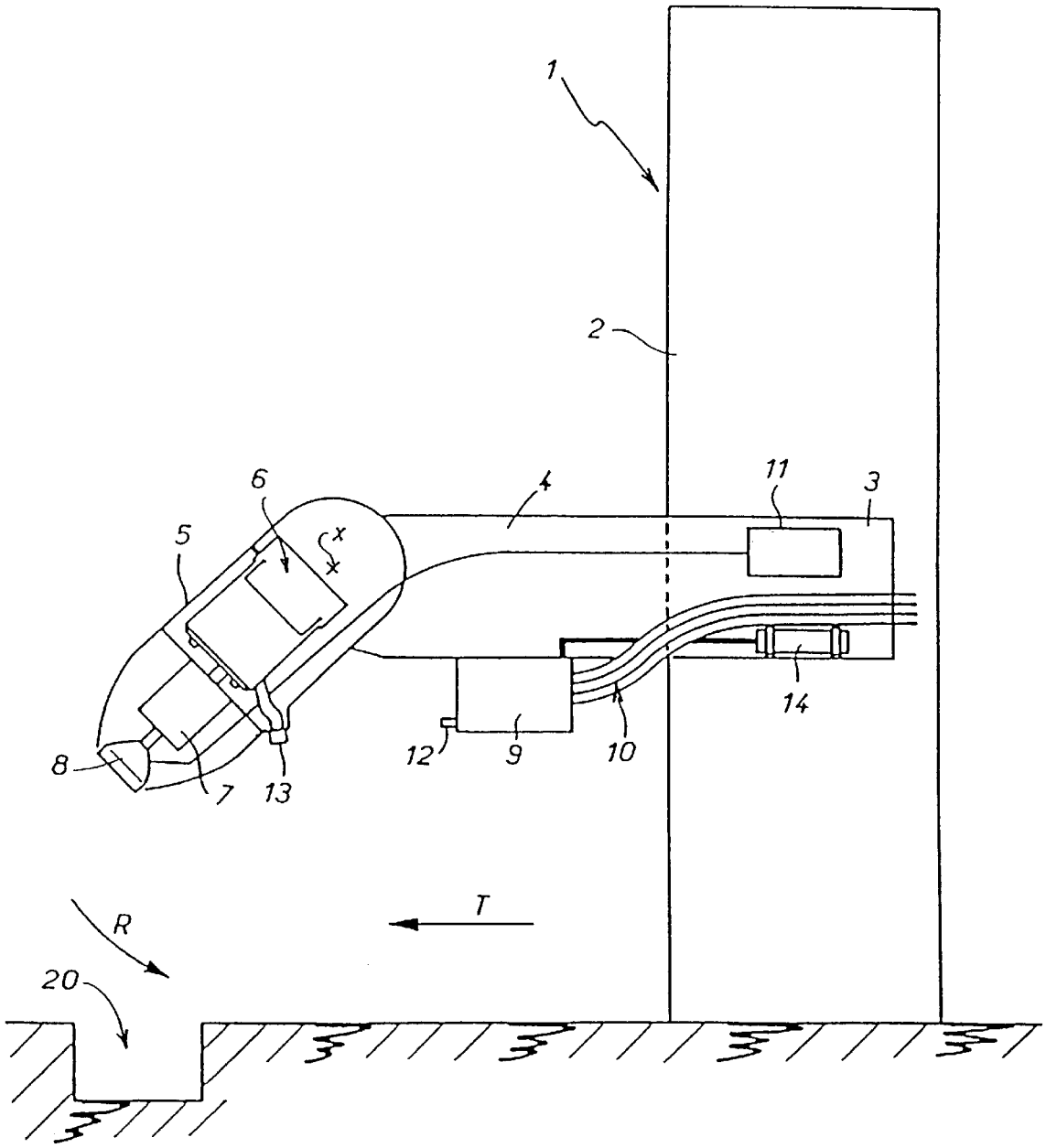
FIG. 1 is an elevational view of a "lateral machine" for spraying a coating material according to the invention.

The lateral machine 1 shown in FIG. 1 includes primarily a body 2 at the interior of which there is vertically movable a carriage 3 carrying an arm 4. The means for displacing and guiding the carriage are not shown in order to not complicate the drawing. At the extremity of arm 4 is installed a support 5 containing a supply tank with a piston 6 and an air turbine 7 for a sprayer 8. The support 5 can pivot with respect to the arm 4 around an axis x. The air turbine 7 is compact, so that the distance between the supply tank 6 and the edge of the spraying element in the form of a bowl is less than 200 mm, for example of the order of 150 mm. The arm 4 supports a coating material changing assembly 9, hung onto the lower part of said arm and supplied with coating material, air and solvent by a bundle of flexible conduits 10.

For electrostatic coating, a high voltage assembly 11, regulatable or interruptable, is installed in the carriage and connected by a high voltage wire to the sprayer. On the other hand, the outlet of the coating material changing assembly 9 is equipped with rapid connection means 12 capable of cooperating with complementary rapid connection means 13 supported by the support 5. The complementary rapid connection means communicate with the supply tank 6. The coating material changing assembly 9 is adapted to slide along the arm 4, by being driven by a jack 14.

The operation is the following.

In the spraying phase, the supply tank 6 supplies the spraying tank with coating material while the bowl is disconnected from the coating material changing assembly 9. The piston of the supply tank is driven by compressed air. Under these conditions, it is possible to apply the high voltage to the sprayer 8 and to the supply tank 6 which are isolated from ground, even if the coating material is conductive. When it is necessary to fill the supply tank 6, possibly with a coating material of another color, i.e. for example during the time which elapses between the distancing of a body from the sprayer and the arrival of the following body, the support 5 undergoes a rotational movement in the sense of arrow R, which has a tendency to direct the sprayer 8 downwardly. At the same time, the coating material changing assembly 9 undergoes a translation in the direction of the support 5, in the sense of arrow T, under the action of the jack 14. These two movements have for their effect to connect the outlet of assembly 9 to the supply tank 6 by connection of the rapid connection means 12 and 13. These operations take place from the end of the coating phase while the arm 4 is in movement. In other words, it is not necessary to displace the supply tank 6 and the sprayer 8 toward any location before undertaking the actions of cleaning and filling.

In the case where the color utilized effectively changes, the first operation consists in circulating into the supply tank 6 and into the sprayer 8 a solvent for cleaning the residues of the preceding coating material. Since the piston of the supply tank 6 is practically applied against the end wall of said supply tank, the volume to be cleaned is small because the conduits between the coating material changing assembly and the supply tank on the one hand and between the supply tank and the sprayer on the other hand are short due to the proximity of these different elements and also due to the compactness of the air turbine 7. The sprayer 8 being directed toward the bottom, the solvent which traverses it can be emptied into a grating, or gutter, 20 or any other adapted recuperation device situated in general in proximity to the floor of the booth. It is then possible to fill the supply tank 6 with the necessary quantity of paint for the coating of the following object. At the end of this operation, the rapid connection means 12 and 13 are disconnected and coating of the following object can commence immediately.

In the case of electrostatic application of a conductive coating material, it is sufficient to cut off the high voltage supply for the sprayer 8 before coupling the connection means 12 and 13.

Figure 2:
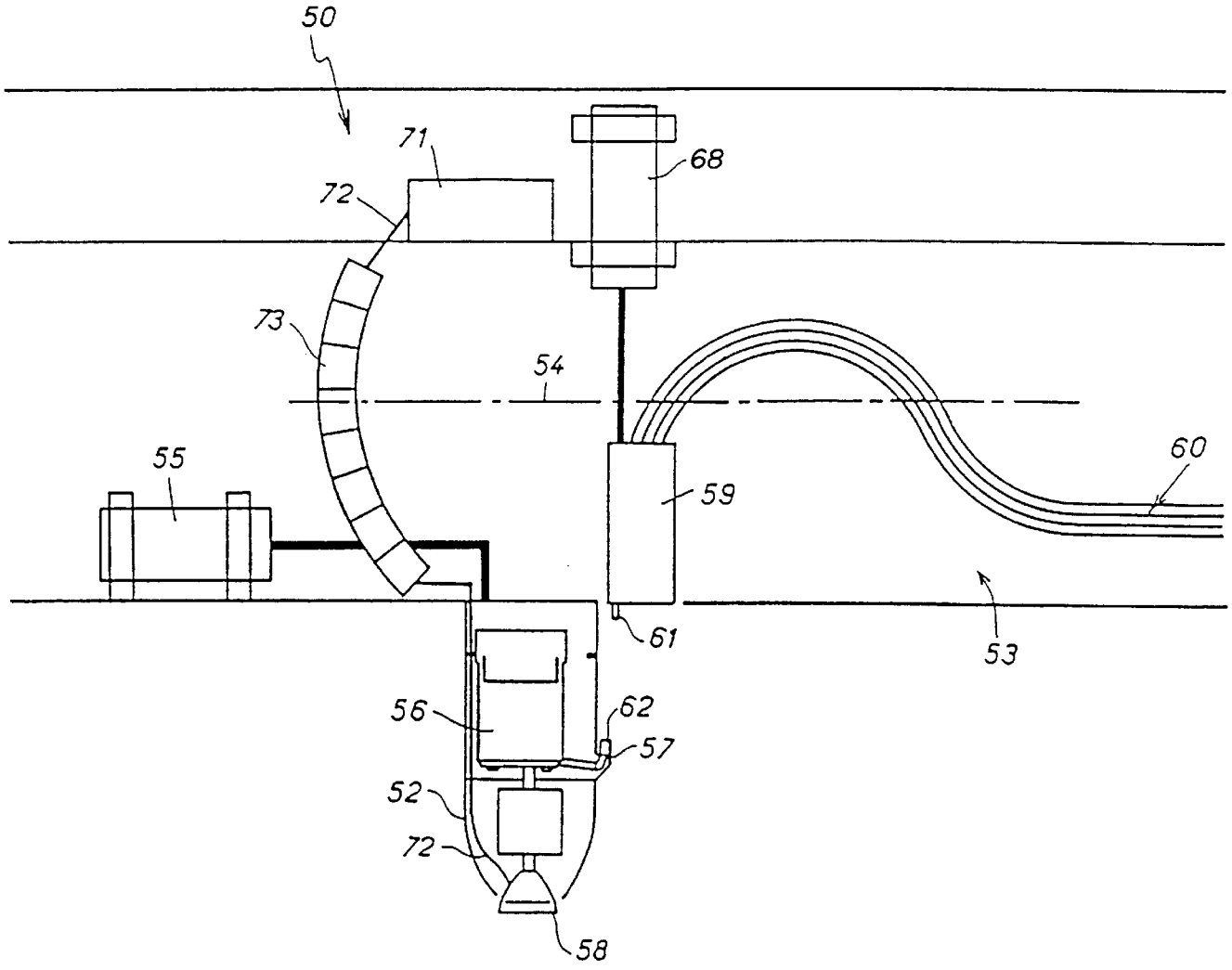
FIG. 2 is a cross-sectional view of the beam of a first embodiment of a "roof machine" for spraying coating material according to the invention.

FIG. 2 shows the beam 50 of a "roof machine". The supply tank 56 and the sprayer 58 are housed in a support 52 projecting downwardly at the exterior of the body 53 of the beam. This support is movable in translation parallel to the axis 54 of the beam by means of a jack 55 supported thereby. One can thus control the sweeping movements of the sprayer 58 in order to obtain a uniform surface state. A coating material changing assembly 59, supplied by a bundle of flexible conduits 60 for delivery of coating material, solvent and compressed air, is housed at the interior of the beam during the coating phases, which prevents it from disturbing the flow of air around the beam or from soiling it by drops of the coating material. The coating material changing assembly 59 is in addition mounted to be vertically movable along a path near an end position of the support 52. It is displaced under the action of a jack 68 carried by the beam. Under the action of this jack, the coating material changing assembly exits from the body 53 of the beam and is lowered until coming to bear against a docking surface 57 of the support 52, when the latter is found in said end position. Complementary rapid connection means, 61 and 62, are mounted respectively at the outlet of the coating material changing assembly 59 and on the docking surface 57. The connection means 62 communicate with the supply tank 56. When the support 52 is in its extreme position and when assembly 59 is lowered under the action of the jack 68, rapid connection means 61 and 62 are coupled.

The operation is of the same type as that which is described with reference to FIG. 1. During the coating phases, the distance between the connection means 61 and 62 permits avoidance of the formation of electric arcs between the coating material changing assembly connected to ground and the assembly of the elements comprised in the support 52, which are at a high voltage. At the moment of the cleaning-filling operations, the high voltage supply is interrupted and the coating material changing assembly is connected to the supply tank 56 by the intermediary of the rapid connection means 61 and 62.

Figure 3:
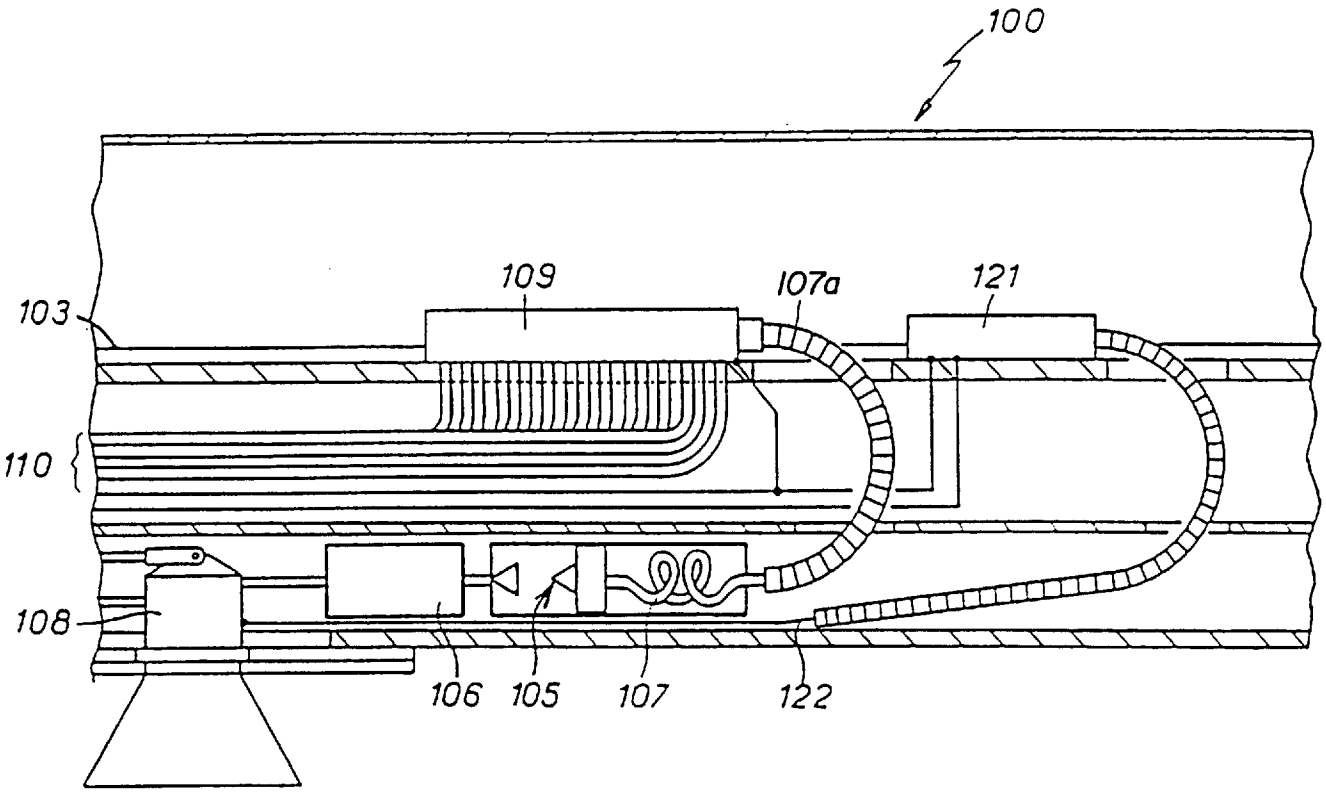
FIG. 3 is a cross-sectional view of the beam of a second embodiment of a "roof machine" for spraying coating material according to the invention.

In the embodiment of FIG. 3, the body 103 of beam 100 contains at the same time a coating material changing assembly 109, a high voltage unit 121, a supply tank 106, a sprayer 108 and a material supply bundle 110 connected to feed the coating material changing assembly. A flexible conduit 107 housed in an uncoiler 107*a* connects the coating material changing assembly 109 to the supply tank 106. An electric and fluid separator 105 is interposed between the conduit 107 and the supply tank 106, in proximity to the latter.

In the coating phase, the separator is open and there is no risk of the high voltage applied to the sprayer 108 creeping to coating material changing assembly 109. When it is necessary to fill the intermediate tank 106, for example during the time interval which separates the removal of an object and the arrival of the following, the high voltage is cut and the separator 105 is closed, which permits flow of the rinsing material, then of the coating material from the coating material changing assembly to the intermediate tank 106.

Figure 4:
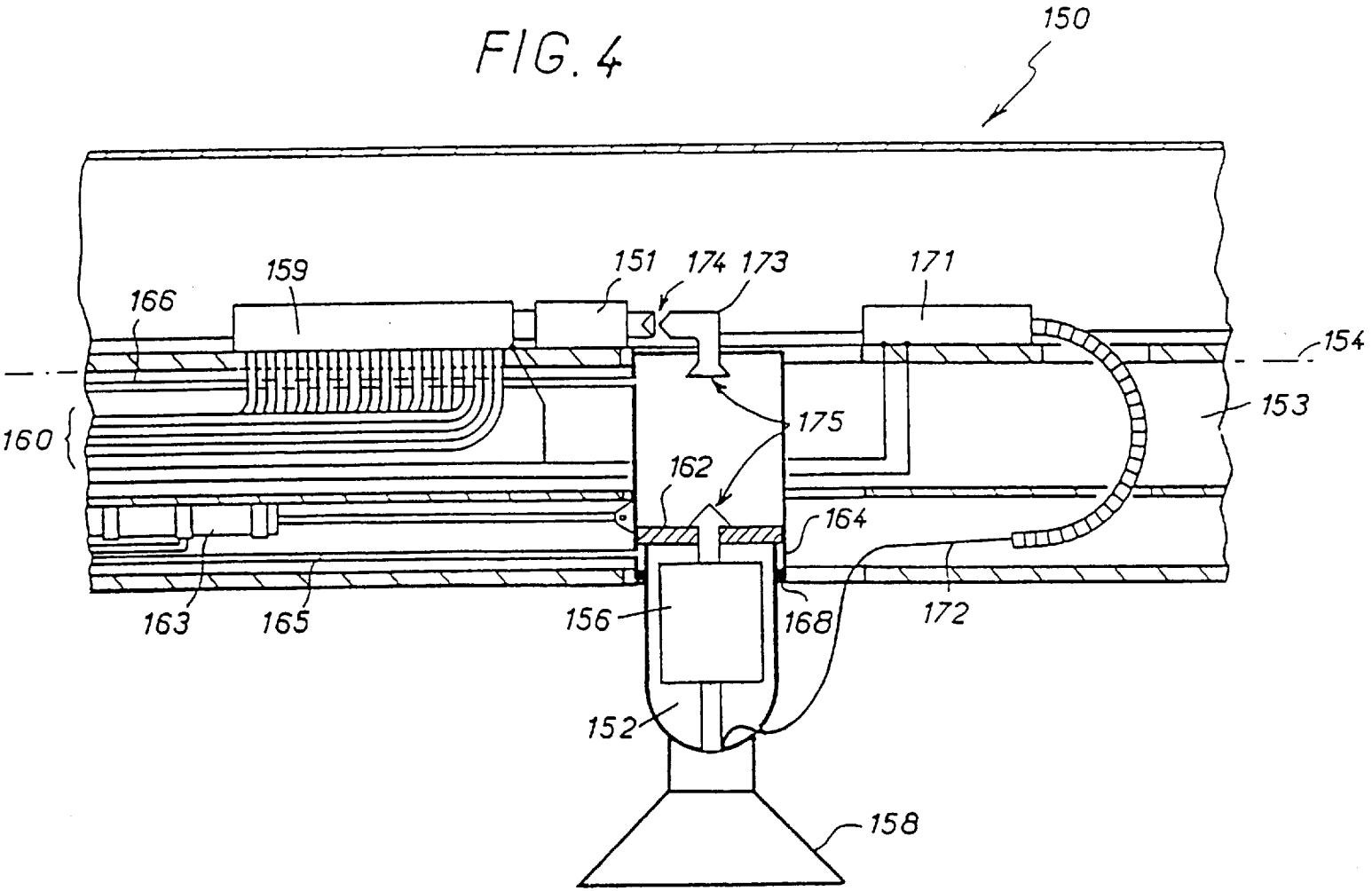
FIG. 4 is a cross-sectional view of the beam of a third embodiment of a "roof machine" for spraying coating material according to the invention.

In the embodiment of FIG. 4, the body 153 of the beam 150 contains at the same time a coating material changing assembly 159, fixed, a high voltage unit 171, a supply tank 156, a sprayer 158, a material supply bundle 160 connected to the coating material changing assembly 159. Downstream of this latter, is installed a cleaningfilling unit 151. The sprayer 158 is mounted at the extremity of an isolating support 152 containing a supply tank 156. The support is movable vertically in translation, i.e. perpendicularly to the axis 154 of the beam, between a lower coating position and an upper cleaning-filling position of the supply tank 156. To do this, the support 152 is fixed to a piston 162 movable in a cylinder 164 with the aid of two air supplies 165 and 166. The conduit 166 opens into a closed upper chamber of the cylinder 164 one wall of which is constituted by the piston 162. The conduit 165 opens into a lower annular chamber defined between the piston 162, the cylinder 164, the support 152 and a hermetic sliding joint 168. The assembly of the cylinder 164 and the objects which it contains is movable under the action of a pneumatic jack 163 parallel to the axis 154 in order to permit sweeping movements of the sprayer 158. An elbow link 173 is installed at the upper part of the cylinder 164. First rapid connection means 174 actuated by the jack 163 are provided between the cleaning-filling unit and the link 173. Second rapid connection means 175 are provided between the link 173 and the inlet of supply tank 156.

The operation is the following.

In the spraying phase, the support 152 is in the low position, the high voltage furnished by the high voltage unit 171 can be applied to the sprayer 158 by the cable 172, without danger of return to ground or toward the coating material changing assembly because the distance between the piston 162 and the cleaning-filling unit 151 is sufficient to permit the electrical isolation. When it is necessary to clean the supply tank 156 and the sprayer 158 and to fill the supply tank 156, the high voltage supply is cut, the cylinder 164 is displaced parallel to the axis 154 by the jack 163 in order to effect closing of the connection means 174 and connection to the cleaning-filling unit 151. The piston 162 is moved back up to effect closing of the connection means 175. The unit 151, the supply tank 156 and the sprayer 158 are thus placed into communication for cleaning and filling operations known to those skilled in the art.

This configuration is particularly advantageous because it permits positioning at different and variable heights the three sprayers carried by the beam of the "roof machine". In particular, during coating of the rear surface of a utility vehicle, it is appropriate to lift the two lateral sprayers for passage of the wheels situated on the sides of the vehicle while the central sprayer must be close to the surface to assure a good surface state.

We claim:

1. Machine for spraying a coating material, said machine comprising: at least one sprayer (8, 58); an on-board supply tank (6, 56) in proximity to said sprayer, said support tank having a first connection means; a coating material changing assembly (9, 59) having a second connection means; and a mobile subassembly (4, 50) carrying said sprayer, said supply tank and said coating material changing assembly, wherein at least one of said connection means is movable between a position in which said first and second connection means are coupled to place said coating material changing assembly in fluid flow connection with said supply tank and a position where said coating material changing assemble is isolated from said supply tank.

2. Machine for spraying a coating material according to claim 1, intended for coating an electrically conductive product, wherein the supply tank (6, 56,) is brought to a high voltage during coating phases during which it is isolated from the coating material changing assembly (9, 59,) and is placed at ground during cleaning and filling phases of said supply tank where it is connected to said coating material changing assembly.

3. Machine for spraying a coating material according to claim 1, wherein the sprayer is of the rotatable type (8, 58,) and the distance between the edge of the bowl of the sprayer and the closest surface of the supply tank (6, 56,) is less than 200 millimeters.

4. Machine for spraying a coating material according to claim 1 wherein said at least one sprayer comprises a plurality of sprayers (158) which are adjustable in height independently of one another.

5. Machine for spraying a coating product according to claim 4, wherein: said machine is a roof machine; said mobile subassembly constitutes a beam of said machine; and said plurality of sprayers are oriented to spray the coating material in a vertical direction.

6. Machine for spraying a coating material according to claim 1 further comprising a drive member connected for moving said at least one of said connection means between the positions and for establishing the position in which said coating product changing assembly is isolated from said supply tank when coating material is being sprayed by said sprayer.

7. Machine for spraying a coating material according to claim 1, wherein said connection means are separated from one another to form an electric isolator when in the position in which said coating product changing assembly is isolated from said supply tank.

8. Machine for spraying a coating material according to claim 1, wherein: said machine is a roof machine; said mobile subassembly constitutes a beam of said machine; said machine further comprises a support (52, 152) forming a projection at the exterior of said mobile subassembly; and said supply tank is housed in said support.

9. Machine for spraying a coating material according to claim 8, wherein the coating material changing assembly (59) is movable between a position at the interior of said mobile subassembly and a position outside of said mobile subassembly.

10. Machine for spraying a coating material according to claim 9, wherein said at least one sprayer comprises a plurality of sprayers (158) which are adjustable in height independently of one another.

11. Roof machine for spraying a coating material, said machine comprising: at least one sprayer (58, 158); an on-board supply tank (56, 156) in proximity to said sprayer; a coating material changing assembly (59, 159); and a mobile subassembly (50, 150) carrying said sprayer, said supply tank and said coating material changing assembly, wherein: said mobile subassembly constitutes a beam of said machine; said machine further comprises a support (52, 152) forming a projection at the exterior of said mobile subassembly; and said supply tank is housed in said support.

12. Machine according to claim 11, wherein said coating material changing assembly is movable between a position at the interior of said mobile subassembly and a position outside of said mobile subassembly.

13. Machine for spraying a coating material according to claim 12, further comprising fluid connection means which are separated from one another to form an electric isolator when said coating product changing assembly is isolated from said supply tank.

14. Machine for spraying a coating material according to claim 12, intended for coating an electrically conductive product, wherein the supply tank is brought to a high voltage during coating phases during which it is isolated from the coating material changing assembly and is placed at ground during cleaning and filling phases of said supply tank where it is connected to said coating material changing assembly.

15. Machine for spraying a coating material according to claim 12, wherein the sprayer is of the rotatable type and that the distance between the edge of the bowl of the sprayer and the closest surface of the supply tank is less than 200 millimeters.

16. Machine for spraying a coating material according to claim 12 further comprising a support carried by said mobile subassembly and supporting said sprayer and said supply tank, and wherein both said support and said coating material changing assembly are movable between a position where they are connected for fluid flow and a position where they are isolated from one another.

17. Machine for spraying a coating material according to claim 11, further comprising fluid connection means which are separated from one another to form an electric isolator when said coating product changing assembly is isolated from said supply tank.

18. Machine for spraying a coating material according to claim 11, intended for coating an electrically conductive product, wherein the supply tank is brought to a high voltage during coating phases during which it is isolated from the coating material changing assembly and is placed at ground during cleaning and filling phases of said supply tank where it is connected to said coating material changing assembly.

19. Machine for spraying a coating material according to claim 11, wherein the sprayer is of the rotatable type and that the distance between the edge of the bowl of the sprayer and the closest surface of the supply tank is less than 200 millimeters.

20. Machine for spraying a coating material according to claim 11 further comprising a support carried by said mobile subassembly and supporting said sprayer and said supply tank, and wherein both said support and said coating material changing assembly are movable between a position where they are connected for fluid flow and a position where they are isolated from one another.

21. Machine for spraying a coating material according to claim 11, wherein said at least one sprayer comprises a plurality of sprayers (158) which are adjustable in height independently of one another.

22. Machine for spraying a coating material according to claim 21, wherein the support (152) supporting the supply tank (156) and the sprayer (158) is vertically movable between an upper position for cleaning-filling of the supply tank (156) and of the sprayer (158) and a lower position for coating.

23. Machine for spraying a coating material, said machine comprising: at least one sprayer (8, 158); an on-board supply tank (6, 156) in proximity to said sprayer; a coating material changing assembly (9, 159); a mobile subassembly (4, 150) carrying said sprayer, said supply tank and said coating material changing assembly; and a support carried by said mobile subassembly and supporting said sprayer and said supply tank, and wherein said support is movable between a position in which said coating material changing assembly is connected to said supply tank for fluid flow and a position where said coating product changing assembly and said supply tank are isolated from one another.

24. Machine for spraying a coating material according to claim 23, further comprising fluid connection means which are separated from one another to form an electric isolator when said coating product changing assembly is isolated from said supply tank.

25. Machine for spraying a coating material according to claim 23, intended for coating an electrically conductive product, wherein the supply tank is brought to a high voltage during coating phases during which it is isolated from the coating material changing assembly and is placed at ground during cleaning and filling phases of said supply tank where it is connected to said coating material changing assembly.

26. Machine for spraying a coating material according to claim 23, wherein the sprayer is of the rotatable type and that the distance between the edge of the bowl of the sprayer and the closest surface of the supply tank is less than 200 millimeters.

27. Machine for spraying a coating material according to claim 23, further comprising a support carried by said mobile subassembly and supporting said sprayer and said supply tank, and wherein both said support and said coating material changing assembly are movable between a position where they are connected for fluid flow and a position where they are isolated from one another.

* * * * *

UNITED STATES PATENT AND TRADEMARK OFFICE

CERTIFICATE OF CORRECTION

PATENT NO. : 5,772,125

DATED : June 30, 1998

INVENTOR(S) : EHINGER et al.

It is certified that error appears in the above-identified patent and that said Letters Patent is hereby corrected as shown below:

On the title page, change "[75] Pierre Ehinger, Faverged; Djamel Merabot, Grenoble, both of France" to -- [75] Pierre Ehinger, Faverges; Djamel Merabet, Grenoble, both of France--.

Signed and Sealed this

Sixteenth Day of February, 1999

*Attest:*

*Acting Commissioner of Patents and Trademarks*

*Attesting Officer*

UNITED STATES PATENT AND TRADEMARK OFFICE

CERTIFICATE OF CORRECTION

PATENT NO. : 5,772,125

DATED : June 30, 1998

INVENTOR(S) : EHINGER et al.

It is certified that error appears in the above-identified patent and that said Letters Patent is hereby corrected as shown below:

On the title page: Item [73]

Please change "[73] Assignee: Sames S.A., Melan, France" to --[73] Assignee: Sames S.A., Meylan, France--.

Signed and Sealed this

Second Day of March, 1999

*Attest:*

Q. TODD DICKINSON

*Attesting Officer*

*Acting Commissioner of Patents and Trademarks*